US007059901B2

(12) United States Patent
Morita et al.

(10) Patent No.: US 7,059,901 B2
(45) Date of Patent: Jun. 13, 2006

(54) WATERPROOF ELECTRICAL CONNECTOR

(75) Inventors: Makoto Morita, Aichi (JP); Eiji Takeda, Aichi (JP); Kinji Nakamura, Aichi (JP)

(73) Assignee: J.S.T. MFG. Co., Ltd., Osaka (JP)

( * ) Notice: Subject to any disclaimer, the term of this patent is extended or adjusted under 35 U.S.C. 154(b) by 0 days.

(21) Appl. No.: 11/046,819

(22) Filed: Feb. 1, 2005

(65) Prior Publication Data

US 2005/0176295 A1 Aug. 11, 2005

(30) Foreign Application Priority Data

Feb. 5, 2004 (JP) ..... 2004-029764

(51) Int. Cl.
*H01R 13/40* (2006.01)

(52) U.S. Cl. ..... 439/587; 439/271

(58) Field of Classification Search ..... 439/587, 439/271, 589, 274, 275
See application file for complete search history.

(56) References Cited

U.S. PATENT DOCUMENTS 4,690,478 A * 9/1987 Rahrig et al. ..... 439/271
4,711,509 A * 12/1987 Cross et al. ..... 439/587
4,772,217 A * 9/1988 Petersen ..... 439/278
4,921,437 A * 5/1990 Cooper et al. ..... 439/275
6,116,952 A * 9/2000 Nakata ..... 439/587
6,273,729 B1 * 8/2001 Kelly ..... 439/36
6,558,178 B1 * 5/2003 Nakamura ..... 439/271
2001/0024907 A1 * 9/2001 Murakami et al. ..... 439/587

FOREIGN PATENT DOCUMENTS

JP 07-142116 A 6/1995

* cited by examiner

*Primary Examiner*—Hien Vu
(74) *Attorney, Agent, or Firm*—Rader Fishman & Grauer PLLC

(57) ABSTRACT

A waterproof electrical connector comprises first and second connectors which are connected to each other. The first connector comprises a first housing in a cylindrical shape having a fitting recess. The second connector comprises a second housing. A sealing member held in a holding groove on the outer periphery of the second housing seals the fitting recess in a state where it is fitted in the fitting recess. The second housing has first and second sections on both sides with the holding groove interposed therebetween. The first section comprises a plurality of cylindrical sections extending along a connector connection direction from a peripheral sidewall adjacent to the holding groove. The cylindrical section comprises guiding sections inserted into the fitting recess prior to inserting the sealing member into the fitting recess for guiding the insertion of the sealing member into the fitting recess.

11 Claims, 9 Drawing Sheets

WATERPROOF ELECTRICAL CONNECTOR

CROSS REFERENCE TO RELATED APPLICATION

The present application corresponds to Japanese Patent Application Serial NO. 2004-29764 filed with the Japanese Patent Office on Feb. 5, 2004, the disclosure of which is incorporated herein by reference.

BACKGROUND OF THE INVENTION

1. Field of the Invention

The present invention relates to a waterproof electrical connector comprising first and second connectors which are connected to each other.

2. Description of Related Arts

This type of connector is used for applications requiring a relatively slight degree of waterproof properties, for example, a toilet seat with bidet that sprays hot water from underneath and dries with air.

Generally, an annular waterproof packing is arranged on the outer periphery at a front end of a cylindrical housing of a male connector. When the male connector is inserted into a cylindrical housing of a female connector, therefore, the waterproof packing is first inserted.

In this case, if fitting accuracy between the housings of both the connectors is made too strict, it becomes difficult to insert the waterproof packing, so that the fitting accuracy between the housings is a little loosely set.

When positioning between the housings is bad, however, an end surface on the side of connection of the housing of the male connector is abutted against a contact (e.g., a post pin) of the female connector, so that a smooth fitting operation between both the connectors may not be attained.

On the other hand, it is proposed that a front end in the connector connection direction of the housing of the male connector has a double cylindrical structure having an inner cylinder and an outer cylinder, and an annular waterproof packing is arranged on the outer periphery of the inner cylinder (see Japanese Patent Laid-Open Gazette No. 07-142116, for example).

In this case, when the male connector is connected to a female connector that is its counterpart, a cylindrical housing of the female connector is inserted between the outer cylinder and the waterproof packing. At this time, the outer cylinder of the housing of the female connector is fitted in the inner periphery of the outer cylinder to position the housings of both the connectors, thereby enhancing fitting accuracy between the housings.

Since the double cylindrical structure is used, however, the configuration becomes complicated, so that the connector increases in size.

An object of the present invention is to provide a waterproof electrical connector whose configuration can be simplified and which is small in size.

SUMMARY OF THE INVENTION

In order to attain the above-mentioned object, in a preferred mode of the present invention, a waterproof electrical connector comprises first and second connectors which are connected to each other, and an annular sealing member. The first connector comprises a first housing in a cylindrical shape having a fitting recess and a plurality of first contacts held by the first housing. The second connector comprises a second housing in a cylindrical shape having a portion inserted into the fitting recess along a predetermined connection direction and fitted in the fitting recess and a plurality of second contacts held by the second housing. The second housing comprises an outer periphery, a holding groove formed on the outer periphery for holding the sealing member, and first and second sections formed on both sides with the holding groove interposed therebetween, the first section being arranged nearer to the predetermined connection direction than the second section. The first section in the second housing comprises a peripheral sidewall adjacent to the holding groove and a plurality of cylindrical sections extending along the predetermined connection direction from the peripheral sidewall. The cylindrical section comprises guiding sections inserted into the fitting recess prior to inserting the sealing member into the fitting recess for guiding the insertion of the sealing member into the fitting recess. The sealing member held in the holding groove in the second housing seals the fitting recess in a state where it is fitted in the fitting recess.

In the present mode, at the beginning of an operation for connecting both the connectors, both the housings can be positioned from each other by fitting the guiding section in the fitting recess. In the positioned state, the sealing member can be smoothly inserted into the fitting recess, and the contacts in both the connectors can be smoothly connected to each other. Miniaturization can be achieved in a simple structure which does not use a conventional double cylindrical structure.

DETAILED DESCRIPTION OF THE PREFERRED EMBODIMENT

A preferable embodiment of the present invention will be described while referring to the accompanying drawings.

Figure 1:
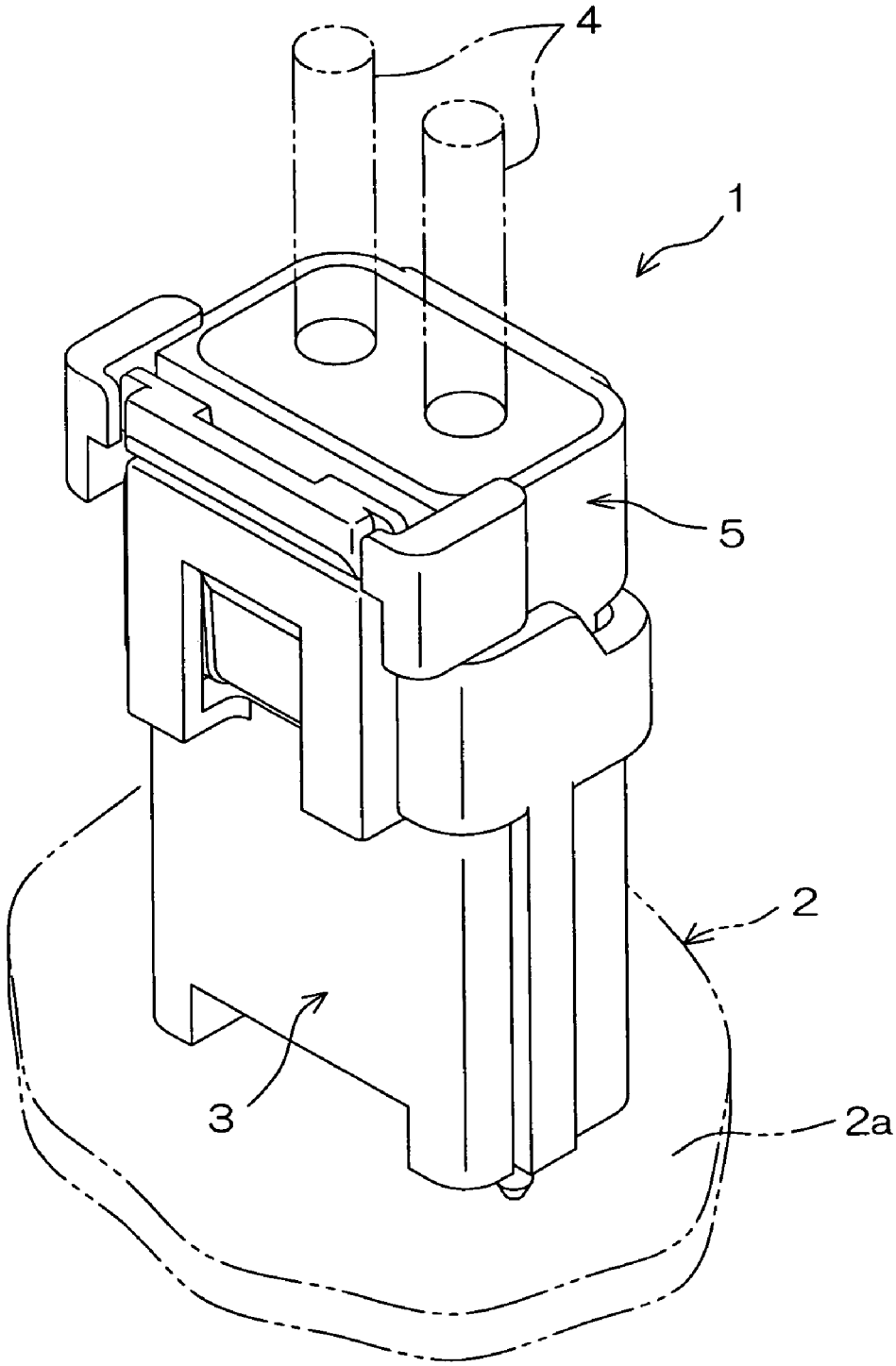
FIG. 1 is a schematic perspective view of a waterproof electrical connector according to an embodiment of the present invention.
Figure 2:
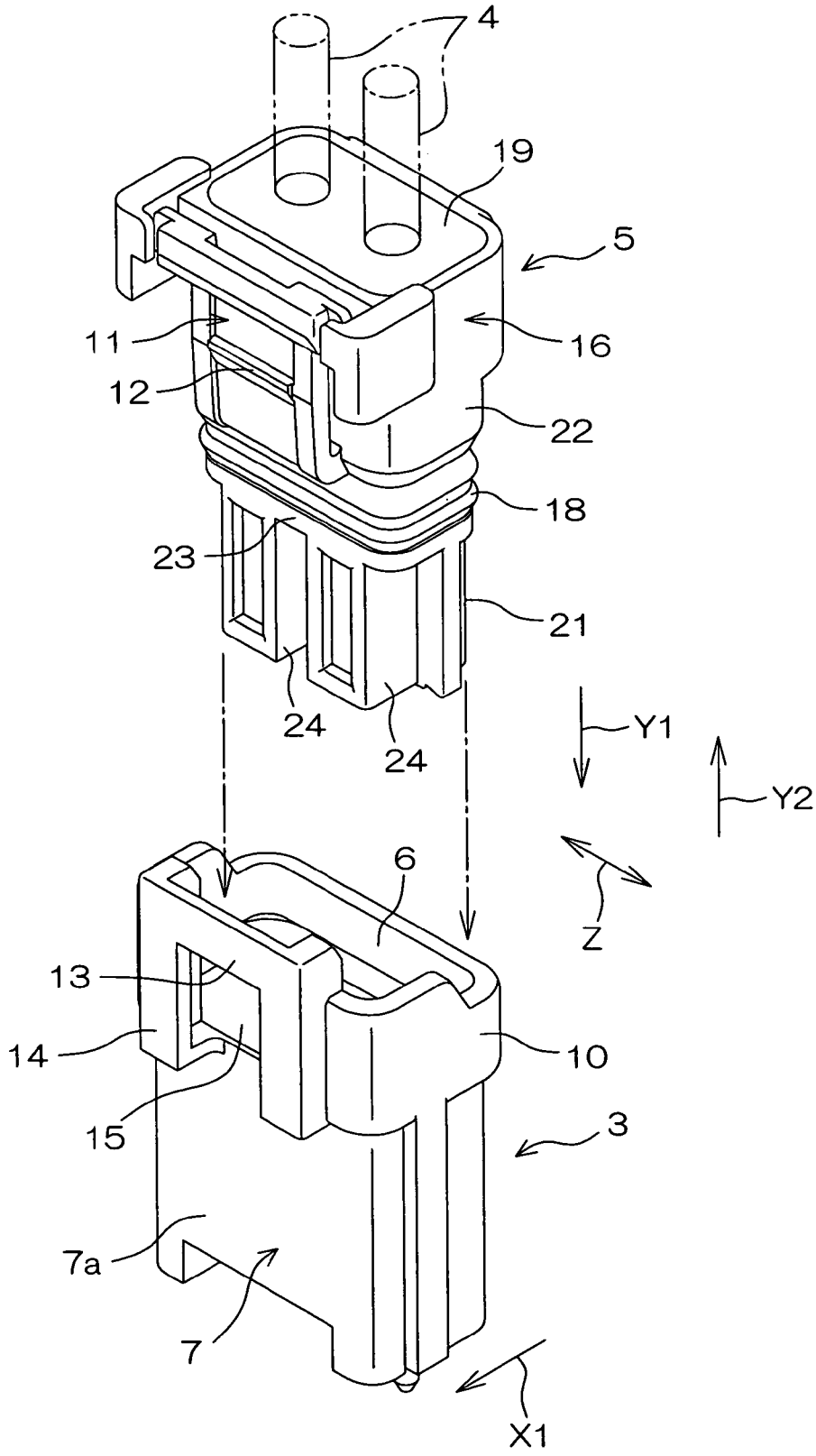
FIG. 2 is an exploded perspective view of a base connector and a socket connector which constitute a waterproof electrical connector.
Figure 3:
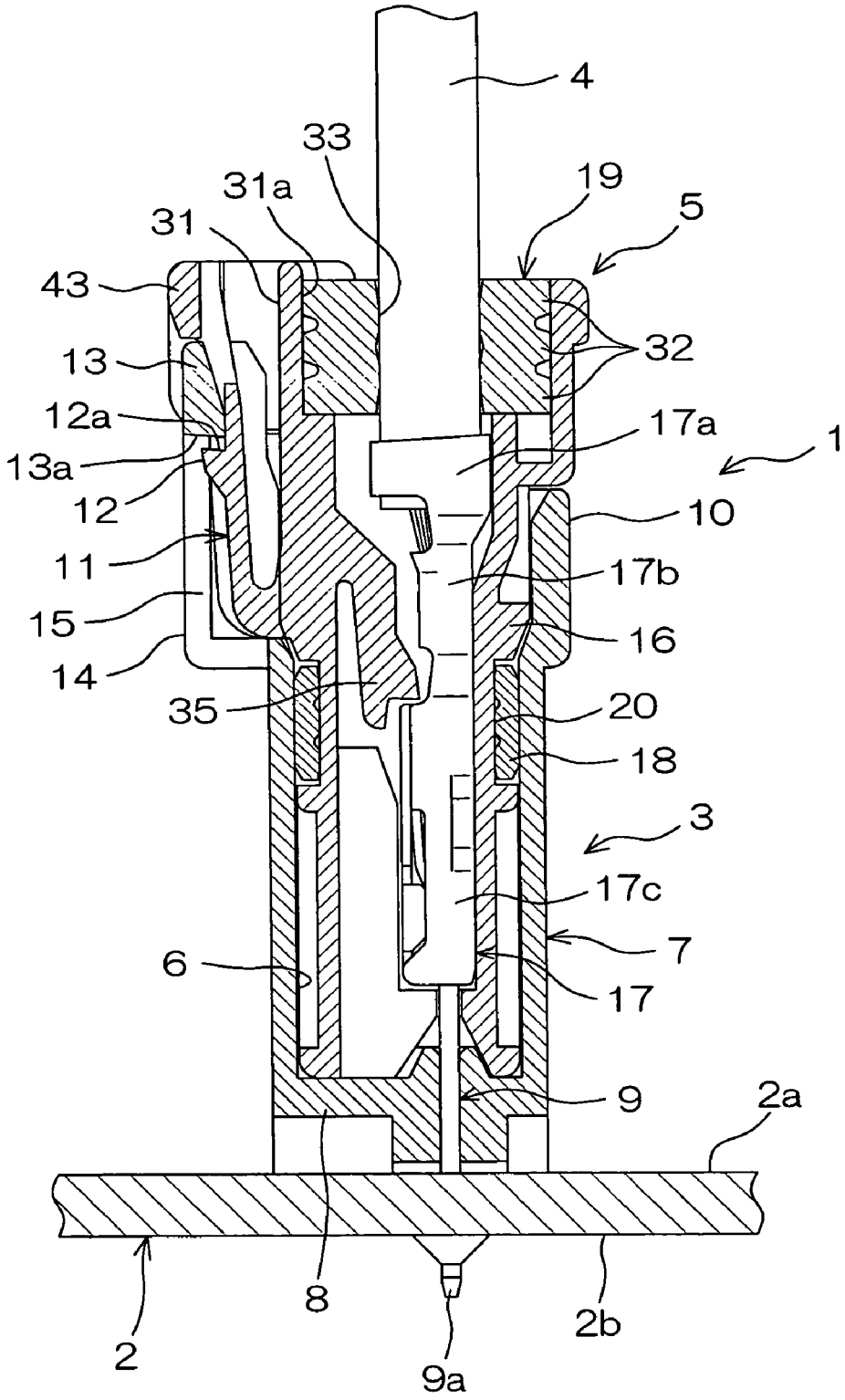
FIG. 3 is a cross-sectional view of a waterproof electrical connector.

FIG. 1 is a schematic perspective view of a waterproof electrical connector according to an embodiment of the present invention, FIG. 2 is an exploded perspective view, and FIG. 3 is a schematic cross-sectional view. Referring to FIG. 1, a waterproof electrical connector 1 comprises a base connector 3 serving as a first connector mounted on a surface 2*a* of a substrate 2 and a socket connector 5 serving as a second connector connected to an end of an electric wire 4 such that they can be connected to each other.

Referring to FIGS. 2 and 3, the base connector 3 comprises a base housing 7 serving as a first housing in a cylindrical shape having a fitting recess 6, and a base contact 9 serving as a first contact held by a bottom wall 8 of the fitting recess 6 in the base housing 7. Referring to FIG. 3, the base contact 9 is composed of a post pin having a longitudinal plate shape. The base contact 9 is fixed to the bottom wall 8 in a state where it penetrates the bottom wall 8, and comprises a lead 9*a* projecting outward from the bottom wall 8. The lead 9*a* is soldered to a conductive portion on a reverse surface 2*b* of the substrate 2 through the substrate 2, for example.

Referring to FIG. 2, the base housing 7 forms an inlet frame 10 having a square annular shape by making an inlet of the fitting recess 6 larger than that on the innermost side. The inlet frame 10 is provided with a locking section 13 which is engaged with an engagement claw 12 in a cantilevered elastic arm 11, described later, in the socket connector 5 for locking both the connectors 3 and 5 to each other.

Specifically, the inlet frame 10 comprises a projection 14 projecting forward X1 in correspondence with a front surface 7*a* of the base housing 7. The projection 14 is formed with an opening 15 having a rectangular shape, so that the remaining portion of the projection 14 has an arch shape. The locking section 13 is composed of a transverse bar arranged at an upper edge of the arch of the projection 14.

Figure 4:
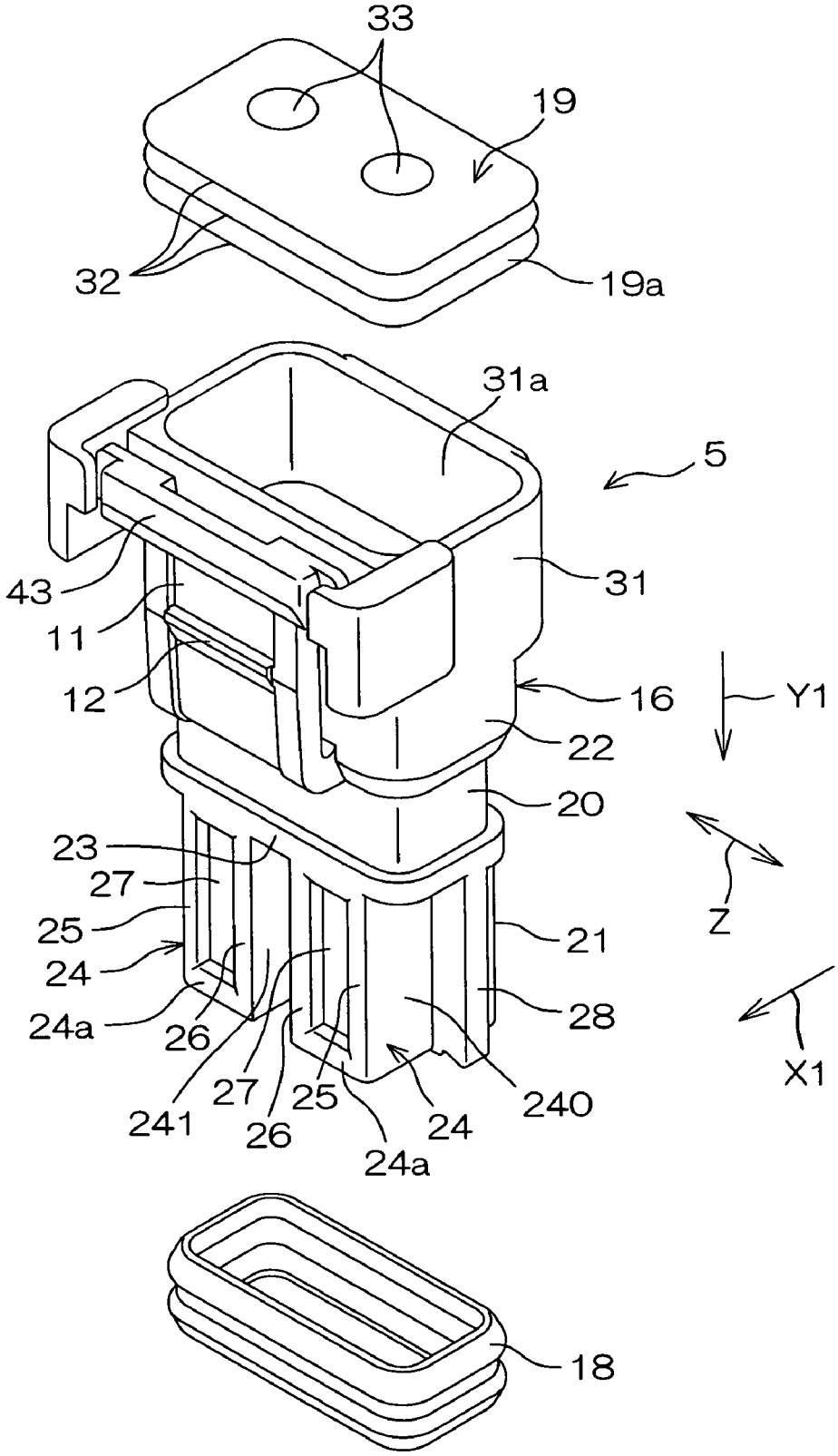
FIG. 4 is an exploded perspective view of a socket connector.

Referring to FIGS. 2, 3, and 4, the socket connector 5 comprises a socket housing 16 serving as a cylindrical second housing a part of which is inserted into the fitting recess 6 in the base connector 3, a socket contact 17 serving as a second contact held in the socket housing 16 and connected to an end of the electric wire 4, an annular sealing member 18 held by the socket housing 16 in order to seal a portion between the socket housing 16 inserted into the fitting recess 6 in the base connector 3 and an inner surface of the fitting recess 6, and a plate-shaped packing 19 for sealing an introduction portion of the electric wire 4 from the socket connector 5.

Referring to FIG. 3, the socket housing 17 comprises an insulation barrel 17*a* for pressing a coating portion of the electric wire 4, a wire barrel 17*b* for pressing a core line serving as a stripping end of the electric wire 4, and a square cylinder 17*c* containing an elastic contact composed of a folded piece in this order. The socket housing 16 comprises a housing lance 35 which is engaged with the square cylinder 17*c* in the socket contact 17 to prevent the socket contact 17 from slipping off.

Figure 6:
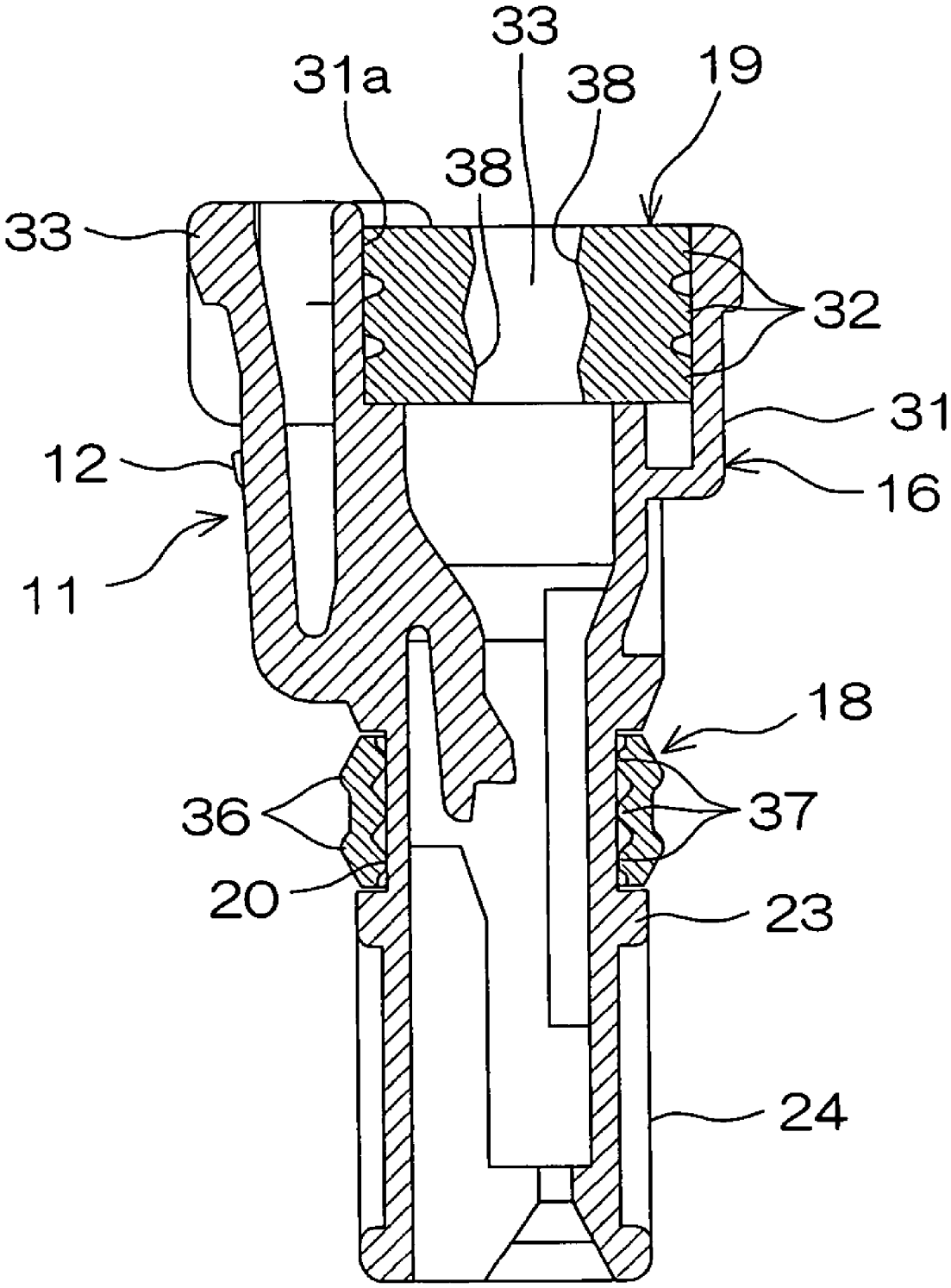
FIG. 6 is a cross-sectional view of a socket housing on which a sealing member and a plate-shaped packing are mounted.

The sealing member 18 is held in an annular holding groove 20 formed on the outer periphery of a halfway portion in a connector connection direction Y1 of the outer periphery 16*a* of the socket housing 16. Referring to FIG. 6, the annular sealing member 18 is composed of an elastic member such as rubber, and annular outward projections 36 and inward projections 37 are alternately formed, to form a waveform shape in cross section. Consequently, the sealing properties of the sealing member 18 can be significantly improved.

The socket housing 16 comprises first and second sections 21 and 22 which are arranged on both sides with the holding groove 20 (i.e., the sealing member 18) interposed therebetween. The first section 21 in the socket housing 16 is arranged nearer to the connector connection direction Y1 than the holding groove 20.

The first section 21 in the socket housing 16 comprises a peripheral sidewall 23 for defining one side of the holding groove 20, and a plurality of cylindrical sections 24 (a pair of cylindrical sections in the present embodiment), which are rectangular in cross section, extending so as to be longer in the connector connection direction Y1 than the peripheral sidewall 23, branched from each other, and arranged in a rightward-and-leftward direction Z. A fitting groove 41 (see FIG. 7) is formed between the pair of cylindrical sections 24.

Figure 5:
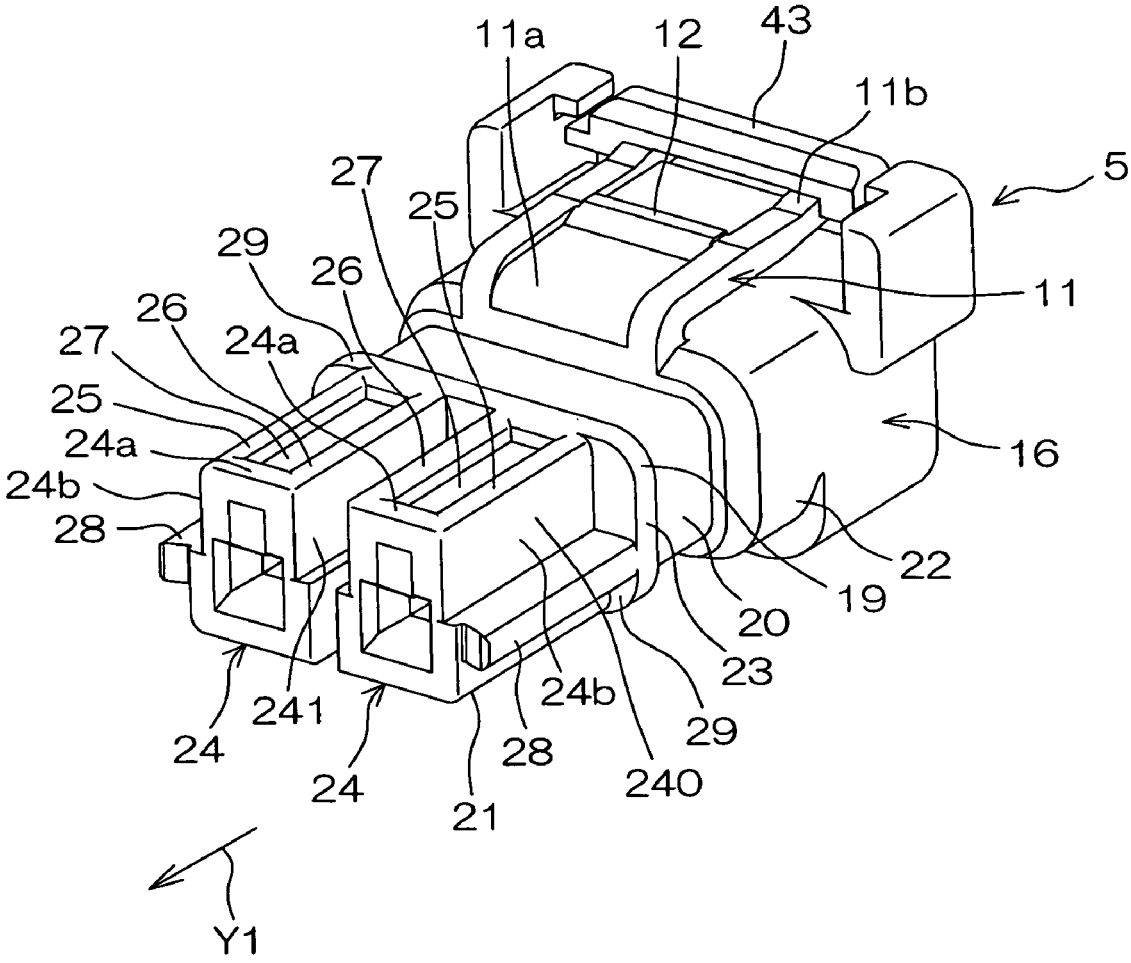
FIG. 5 is a perspective view of the socket connector as viewed obliquely from below.
Figure 7:
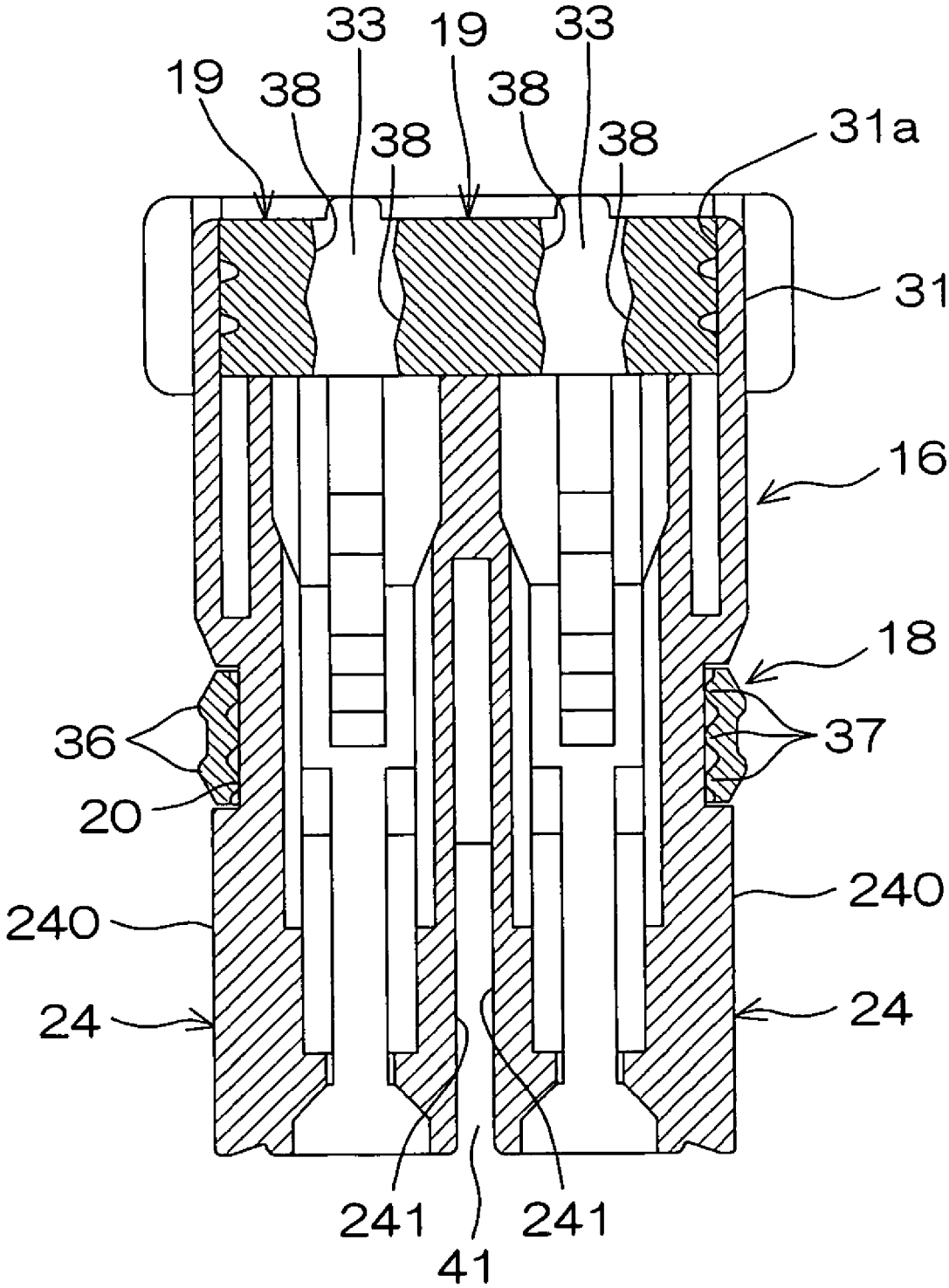
FIG. 7 is a cross-sectional view of a socket housing on which a sealing member and a plate-shaped packing are mounted.

Referring to FIG. 5, each of the cylindrical sections 24 has a square annular shape in cross section. Referring to FIGS. 4, 5, and 7, the cylindrical sections 24 respectively comprise outer peripheral surfaces 240. The outer peripheral surface 240 of each of the cylindrical sections 24 comprises an opposite surface 241 opposed to the other cylindrical section 24. Referring to FIGS. 4 and 5, first and second ribs 25 and 26 extending along the connector connection direction Y1 are formed on each of a front surface 24*a* and a rear surface (not shown) of each of the cylindrical sections 24. The second ribs 26 are respectively arranged at edges, which are nearer to each other, of the cylindrical sections 24, and the first ribs 25 are respectively arranged at edges, which are farther away from each other, of the cylindrical sections 24. On the front surface 24*a*, a recess 27 is formed between the first and second ribs 25 and 26. The same is true for the rear surface.

The pair of cylindrical sections 24 are respectively formed such that third ribs 28 for preventing reverse insertion extend along the connector connection direction Y1 on side surfaces which are farther away from each other. The third ribs 28 function to prevent the socket housing 16 from being inserted into the fitting recess 6 in the base connector 3 with the front and rear thereof reversed.

The tops of the first and second ribs 25 and 26 on the front surface 24*a* and the rear surface and the second rib 28 on the side surface 24*b* (i.e., the tops of the ribs 25, 26, and 28 formed on the surfaces, excluding the opposite surface 241, on the outer peripheral surface 240 of each of the cylindrical sections 24) are continuous so as to be coplanar with the top of the peripheral sidewall 23 for defining the holding groove 20. Further, the first, second, and third ribs 25, 26, and 28 respectively form guiding sections which are inserted into the fitting recess 6 prior to inserting the sealing member 18 and fitted in the fitting recess 6 when both the connectors 3 and 5 are connected to each other to guide the insertion of the sealing member 18 into the fitting recess 6.

Figure 9:
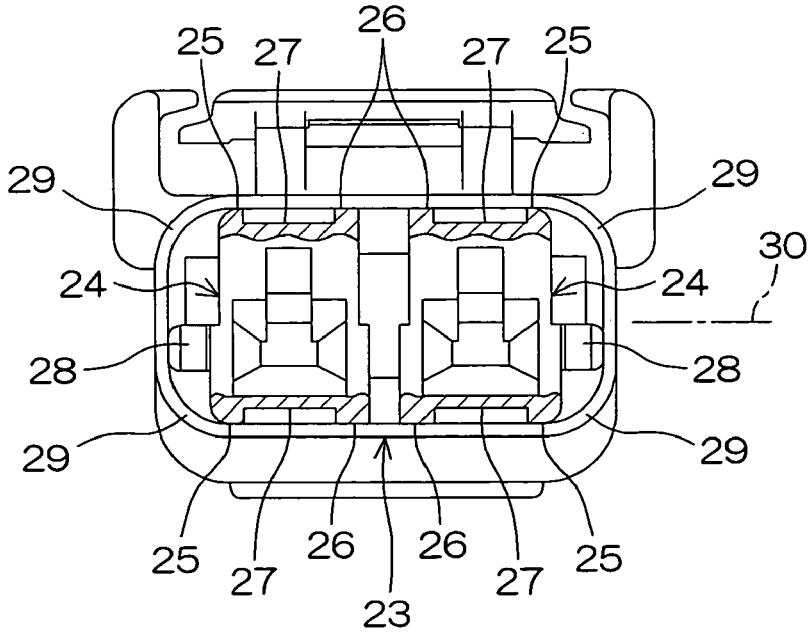
FIG. 9 is a partially broken bottom view of the socket housing.

As shown in FIGS. 5 and 9, when the socket housing 16 is viewed along an opposite direction Y2 to the connector connection direction Y1, the peripheral sidewall 23 has a rectangular shape, and the four corners of the rectangle respectively form curved sections 29. The first ribs 25 respectively connect with portions adjacent to the curved sections 29 at the four corners of the rectangle.

Referring to FIG. 9, the third rib 28 for preventing reverse insertion is arranged at a position offset by a predetermined amount from a center line 30 in a forward-and-backward direction of the cylindrical section 24. The third rib 28 also connects with a portion adjacent to the corresponding curved section 29 of the peripheral sidewall 23.

Referring to FIGS. 3 and 4, the second section 22 in the socket housing 16 comprises an inlet frame 31 having a square annular shape for inserting the electric wire 4 having its end pressed against each of the socket contacts 17. The plate-shaped packing 19 is composed of an elastic member such as rubber. A plate-shaped packing 19 has an outer peripheral surface 19*a* elastically fitted in an inner peripheral surface 31*a* of the inlet frame 31, and a plurality of annular projections 32 extending in a peripheral direction are formed on the outer peripheral surface 19*a*. The annular projections 32 elastically press the inner peripheral surface 31*a* of the inlet frame 31.

The plate-shaped packing 19 is formed with an insertion hole 33 for inserting a coating portion of each of the electric wires 4 with an interference. Specifically, referring to FIGS. 6 and 7, one to a plurality of annular projections 38 extending in the peripheral direction are formed on the inner periphery of the insertion hole 33 of the plate-shaped packing 19. Consequently, the plate-shaped packing 19 seals a portion between the inner peripheral surface 31*a* of the inlet frame 31 and the electric wire 4. The sealing properties of an electric wire passage portion can be ensured by a simple structure using the plate-shaped packing 19.

A base end 11*a* of the above-mentioned elastic arm 11 for locking is arranged adjacent to the holding groove 20 in the second section 22 in the socket housing 16, and the elastic arm 11 extends along the opposite direction Y2 to the connector connection direction Y1 in the socket connector 5. A front end 11*b* of the elastic arm 11 is provided with a release operation section 43. The release operation section 43 is operated so as to be pressed in a locking release direction (a direction nearer to a front surface of the second section 22 in the socket housing 16) by fingers when locking between both the housings 7 and 16 is released.

Figure 8:
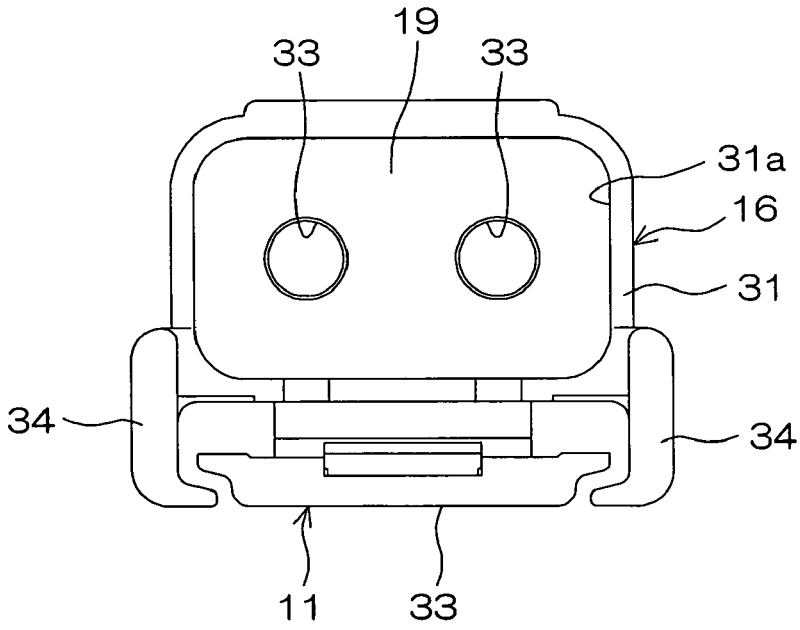
FIG. 8 is a plan view of the socket connector.

The engagement claw 12 is formed so as to project toward an outer surface in an intermediate portion of the elastic arm 11. An engagement surface 12*a* for locking included in the engagement claw 12 is engaged with an engagement surface 13*a* for locking included in the locking section 13 in the base housing 7 opposite to an extracting direction of the socket housing 7, thereby achieving locking for preventing both the connectors 3 and 5 from slipping off. The locking is not released unless the release operation section 43 is operated. As shown in FIG. 8, a pair of right and left protection frames 34 having an L shape in cross section extends from the inlet frame 31 in the socket housing 16, and the protection frames 34 function to provide protection such that right and left edges of the release operation section 43 are not uselessly operated by contact with foreign matter, for example.

Figure 10:
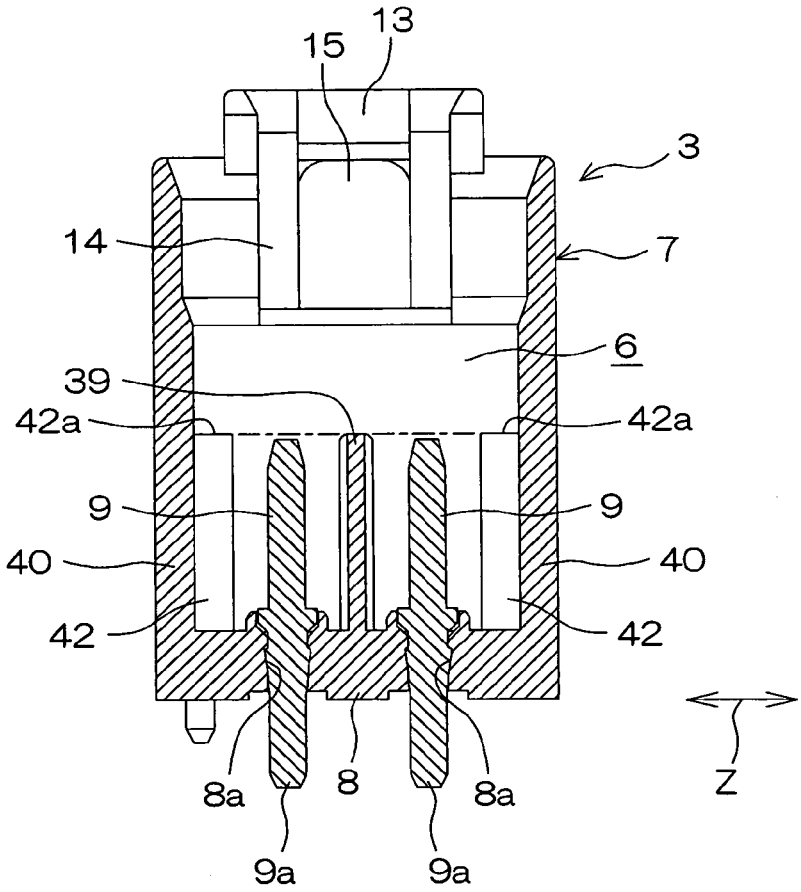
FIG. 10 is a cross-sectional view of the base connector.

Referring to FIG. 10, the base contact 9 is pressed into a through hole 8*a* of the bottom wall 8 in the base housing 7 to engage an engagement projection of its own with the inner periphery of the through hole 8*a* to prevent the base contact 9 itself from slipping off.

Figure 11:
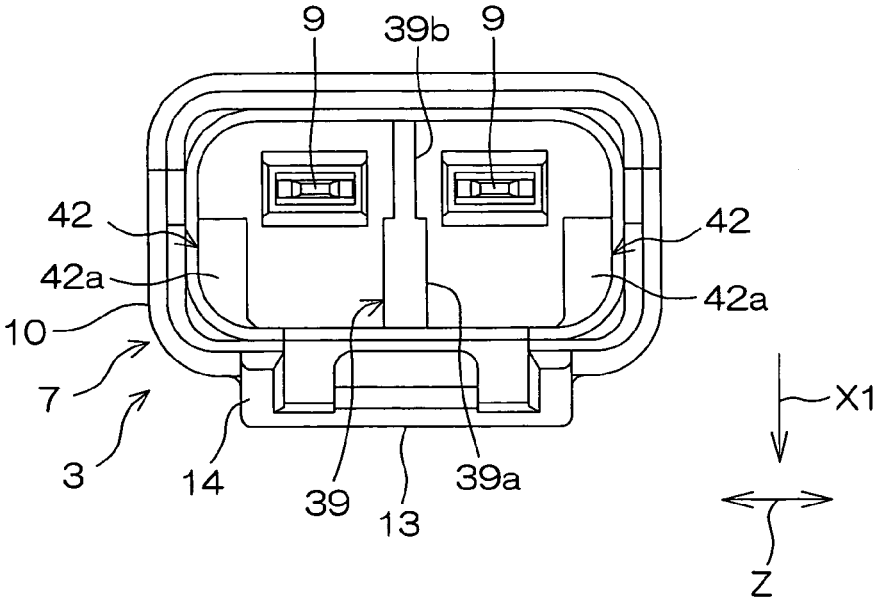
FIG. 11 is a plan view of the base connector.

Referring to FIG. 10 and FIG. 11 which is a plan view of the base connector 3, a partitioning wall 39 serving as a wall between electrodes for partitioning the adjacent base contacts 9 is integrally provided on the bottom wall 8 of the base housing 7. The partitioning wall 39 extends parallel to a sidewall 40 of the base housing 7, and is fitted in the fitting groove 41 (see FIG. 7) between the adjacent cylindrical sections 24 in the socket connector 5 at the time of connector connection. A creepage distance between the adjacent base contacts 9 is provided by the partitioning wall, thereby making it possible to reliably prevent creeping discharge or the like.

The partitioning wall 39 is so adapted that the plate thickness of its front half portion 39*a* is relatively large and the plate thickness of its rear half portion 39*b* is relatively small, while the fitting groove 41 between the cylindrical sections 24 in the socket connector 5 is so adapted that the groove width of its front half portion is relatively large and the groove width of its rear half portion is relatively small, which is not illustrated, to prevent the socket connector 5 from being inserted into the fitting recess 6 in the base connector 3 with the front and rear thereof reversed.

There are provided two regulating ribs 42 along the sidewall 40 from the bottom wall 8 of the base housing 7. The third rib 28 for preventing reverse insertion in the socket connector 5 is arranged so as to be offset backward, while each of the regulating ribs 42 is arranged so as to be offset forward. The top of each of the regulating ribs 42 comprises a receiving section 42*a* receiving a front end of the third rib 28 in the socket housing 16 at the time of reverse insertion of the socket housing 16 to prevent the reverse insertion.

Referring to FIG. 10, the heights of the partitioning wall 39 and the regulating rib 42 from the bottom wall 8 for preventing reverse insertion are made larger than the height of the base contact 9, to reliably prevent the base contact 9 from being deformed by the reverse insertion.

According to the present embodiment, when the annular sealing member 18 is moved with the pair of cylindrical sections 24 collectively coated with the annular sealing member 18 such that the annular sealing member 18 is fitted in the holding groove 20, only the ribs 25, 26, and 28 in the cylindrical section 24 are abutted against the inner periphery of the sealing member 18, so that the contact area thereof with the sealing member 18 can be reduced, thereby making it easy to move the sealing member 18.

Moreover, the top of each of the ribs 25, 26, and 28 is coplanar with the top of the peripheral sidewall 23 for defining one side of the holding groove 20. Therefore, the sealing member 18 can be smoothly fitted in the holding groove 20 without being caught while being guided by each of the ribs 25, 26, and 28, so that assembling properties are good. Thus, the sealing member 18 is easy to assemble because a unit in which the sealing member 18 is mounted on the socket connector 5 may be inserted into the fitting recess 6 in the base connector 3.

At the beginning of a connecting operation of both the connectors 3 and 5, each of the ribs 25, 26, and 28 serving as guiding sections in the socket connector 5 is fitted in the fitting recess 6 in the base connector 3, thereby allowing the housings 7 and 16 in both the connectors 3 and 5 to be positioned from each other. In the positioned state, it is possible to smoothly insert the sealing member 18 into the fitting recess 6 as well as to smoothly connect the contacts 3 and 9 in both the connectors 3 and 5 to each other. Miniaturization can be achieved in a simple structure which does not use a conventional double cylindrical structure.

The fitting recess 6 is sealed by the sealing member 18 arranged in an intermediate portion, in the connector connection direction Y1, of the socket housing 16, and the base contact 9 is introduced into the cylindrical section 24 within the sealed fitting recess 6, thereby allowing the sealing properties to be increased. Since the sealing member 18 is arranged in the intermediate portion in the connector connection direction Y1, thereby making it possible to achieve miniaturization, as compared with that in a case where it is arranged at a front end, in the connector connection direction Y1, of the socket housing 16.

The ribs 25, 26, and 28 respectively connect with portions adjacent to the curved sections 29 at the four corners of the rectangle of the peripheral sidewall 23, so that work for fitting the sealing member 18 in the holding groove 20 becomes easier.

The ribs 25, 26, and 28 for guiding the mounting of the sealing member 18 include the third rib 28 for preventing reverse insertion, as described above, thereby allowing the configuration to be simplified.

The engagement claw 12 in the elastic arm 11 in the socket connector 5 is engaged with the locking section 13 in the base connector 3, thereby making it possible to reliably maintain both the connectors 3 and 5 in a connected state where waterproof properties are ensured.

The present invention is not limited to the above-mentioned embodiment. For example, the cylindrical section 24 may be branched into three or more portions, and a plurality of partitioning walls 39 may be provided.

While the invention has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A waterproof electrical connector comprising:

first and second connectors which are connected to each other; and an annular sealing member, the first connector comprising a first housing in a substantially rectangular shape having a fitting recess and a plurality of first contacts held by the first housing, the second connector comprising a second housing in a substantially rectangular shape having a portion inserted into the fitting recess along a connector connection direction and fitted in the fitting recess and a plurality of second contacts held by the second housing, the second housing comprising an outer periphery, a holding groove formed on the outer periphery for holding the sealing member, and first and second sections formed on both sides with the holding groove interposed therebetween, the first section being arranged nearer to the connector connection direction than the second section, the first section in the second housing comprising a peripheral sidewall adjacent to the holding groove and a plurality of substantially rectangular sections extending along the connector connection direction from the peripheral sidewall substantially rectangular sections defining a longitudinal fitting groove therebetween separating the substantially rectangular sections as individual substantially rectangular sections;

each substantially rectangular section comprising guiding sections having guided ribs inserted into the fitting recess prior to inserting the sealing member into the fitting recess for guiding an insertion of the sealing member into the fitting recess, and the sealing member held in the holding groove in the second housing sealing the fitting recess in a state where the sealing member is fitted in the fitting recess, wherein each of the substantially rectangular sections has an outer peripheral surface, and the guiding ribs are formed on an outer peripheral surface of each of the substantially rectangular sections and extending in the connector connection direction.

2. The waterproof electrical connector according to claim 1, wherein the plurality of substantially rectangular sections are branched from the peripheral sidewall of the first section in the second housing and arranged along a direction parallel to the connector connection direction.

3. The waterproof electrical connector according to claim 1, wherein the outer peripheral surface of each of the substantially rectangular sections comprises an opposite surface opposed to the other substantially rectangular section, and the guiding ribs include the ribs respectively formed on surfaces excluding the opposite surface on the outer peripheral surface of the substantially rectangular section.

4. The waterproof electrical connector according to claim 3, wherein the ribs formed on the surfaces excluding the opposite surface on the outer peripheral surface of each of the substantially rectangular sections respectively comprise tops, and the tops are coplanar with a top of the peripheral sidewall of the first section in the second housing.

5. The waterproof electrical connector according to claim 1, wherein curved sections are respectively provided at the four corners of the rectangular shape, and the guiding ribs include the ribs respectively connecting with portions adjacent to the curved sections at the four corners of the rectangular shape.

6. The waterproof electrical connector according to claim 1, wherein the guiding ribs include the rib for preventing reverse insertion for preventing the second housing from being inserted into the fitting recess in the first housing in a state where a front and a rear of the second housing are reversed in a direction perpendicular to the connector connection direction.

7. The waterproof electrical connector according to claim 1, wherein an outer surface of the second section in the second housing is provided with an elastic arm extending in an opposite direction to the connector connection direction, the elastic arm comprises an engagement claw for locking, and the first housing comprises an inlet frame having a square annular shape in correspondence to an inlet of the fitting recess, the inlet frame including a locking section engaged with the engagement claw in the elastic arm to prevent both the connectors from slipping off.

8. The waterproof electrical connector according to claim 1, wherein the second section in the second housing comprises a frame having a square annular shape for inserting an electric wire whose end is pressed against each of the second contacts, the frame including an inner peripheral surface, a plate-shaped packing for sealing a portion between an inner peripheral surface of a frame of the second section in the second housing and the electric wire, and the plate-shaped packing includes an insertion hole which can be elastically expandable for inserting each of the electric wires.

9. The waterproof electrical connector according to claim 1, wherein the sealing member comprises an elastic member having a wave shape in cross section by alternately providing annular outward projections and annular inward projections on an outer periphery and an inner periphery of the elastic member.

10. A waterproof electrical connector comprising:

first and second connectors which are connected to each other; and an annular sealing member, the first connector comprising a first housing in a substantially rectangular shape having a fitting recess and a plurality of first contacts held by the first housing, the second connector comprising a second housing in a substantially rectangular shape having a portion inserted into the fitting recess along a connector connection direction and fitted in the fitting recess and a plurality of second contacts held by the second housing, the second housing comprising an outer periphery, a holding groove formed on the outer periphery for holding the sealing member, and first and second sections formed on both sides with the holding groove interposed therebetween, the first section being arranged nearer to the connector connection direction than the second section, the first section in the second housing comprising a peripheral sidewall adjacent to the holding groove and a plurality of substantially rectangular sections extending alone the connector connection direction from the peripheral sidewall;

each substantially rectangular section comprising guiding sections inserted into the fitting recess prior to inserting the sealing member into the fitting recess for guiding an insertion of the sealing member into the fitting recess, and the sealing member held in the holding groove in the second housing sealing the fitting recess in a state where the sealing member is fitted in the fitting recess, wherein each of the substantially rectangular sections has an outer peripheral surface, the guiding sections include guiding ribs formed on an outer peripheral surface of each of the substantially rectangular sections and extending in the connector connection direction, the guiding ribs include the rib for preventing reverse insertion for preventing the second housing from being inserted into the fitting recess in the first housing in a state where a front and a rear of the second housing are reversed in a direction perpendicular to the connector connection direction, the first housing comprises a regulating rib provided on a bottom wall of the fitting recess, the regulating rib comprises a receiving section for receiving a front end of the rib for preventing reverse insertion in the second housing at a time of the reverse insertion of the second housing to prevent the reverse insertion, and a height of the receiving section from the bottom wall of the fitting recess is larger than a height of the first contact.

11. A waterproof electrical connector comprising:

first and second connectors which are connected to each other; and an annular sealing member, the first connector comprising a first housing in a substantially rectangular shape having a fitting recess and a plurality of first contacts held by the first housing, the second connector comprising a second housing in a substantially rectangular shape having a portion inserted into the fitting recess along a connector connection direction and fitted in the fitting recess and a plurality of second contacts held by the second housing, the second housing comprising an outer periphery, a holding groove formed on the outer periphery for holding the sealing member, and first and second sections formed on both sides with the holding groove interposed therebetween, the first section being arranged nearer to the connector connection direction than the second section, the first section in the second housing comprising a peripheral sidewall adjacent to the holding groove and a plurality of substantially rectangular sections extending along the connector connection direction from the peripheral sidewall;

each substantially rectangular section comprising guiding ribs inserted into the fitting recess prior to inserting the sealing member into the fitting recess for guiding an insertion of the sealing member into the fitting recess, and the sealing member held in the holding groove in the second housing sealing the fitting recess in a state where the sealing member is fitted in the fitting recess, wherein the first housing comprises a partitioning wall extending from a bottom wall of the fitting recess to partition the first contacts and fitted between adjacent substantially rectangular sections in the second connector, and a height of the partitioning wall from the bottom wall of the fitting recess is larger than a height of the first contact.

* * * * *